US011828027B1

(12) United States Patent
Mort, Jr. et al.

(10) Patent No.: US 11,828,027 B1
(45) Date of Patent: Nov. 28, 2023

(54) FIRE RESISTANT RETAIL PRODUCT PACKAGING MATERIALS AND METHOD OF MANUFACTURING SAME

(71) Applicant: Packaging and Crating Technologies, LLC, Waterbury, CT (US)

(72) Inventors: Rodger A. Mort, Jr., Altmar, NY (US); Guy Leath Gettle, Alamo, CA (US)

(73) Assignee: Packaging and Crating Technologies, LLC, Waterbury, CT (US)

( * ) Notice: Subject to any disclaimer, the term of this patent is extended or adjusted under 35 U.S.C. 154(b) by 0 days.

(21) Appl. No.: 17/899,857

(22) Filed: Aug. 31, 2022

(51) Int. Cl.

| | |
|---|---|
| ***D21H 21/34*** | (2006.01) |
| ***D21H 11/04*** | (2006.01) |
| ***D21H 19/84*** | (2006.01) |
| ***D21H 19/64*** | (2006.01) |
| ***D21H 19/40*** | (2006.01) |
| ***D21H 19/58*** | (2006.01) |
| ***D21H 23/56*** | (2006.01) |

(52) U.S. Cl.
CPC ..... *D21H 21/34* (2013.01); *D21H 11/04* (2013.01); *D21H 19/40* (2013.01); *D21H 19/58* (2013.01); *D21H 19/64* (2013.01); *D21H 19/84* (2013.01); *D21H 23/56* (2013.01)

(58) Field of Classification Search
CPC ..... D21H 21/34; D21H 11/04; D21H 19/40; D21H 19/58; D21H 19/1964; D21H 19/84; D21H 23/56
USPC ..... 162/135
See application file for complete search history.

(56) References Cited

U.S. PATENT DOCUMENTS

| | | | | | |
|---|---|---|---|---|---|
| 4,487,657 | A * | 12/1984 | Gomez | D21H 21/34 | 162/158 |
| 5,405,555 | A * | 4/1995 | Riker | D21H 21/34 | 252/607 |
| 5,679,433 | A * | 10/1997 | Hayashi | D21H 13/40 | 428/116 |
| 9,648,751 | B2 * | 5/2017 | Depres | H05K 3/027 | |
| 10,760,217 | B2 * | 9/2020 | Fantini | D21H 19/52 | |
| 11,028,535 | B2 * | 6/2021 | Mort, Jr. | D21H 21/34 | |
| 11,692,310 | B2 * | 7/2023 | Mort, Jr. | D21F 11/12 | 162/112 |
| 2007/0010386 | A1 * | 1/2007 | Champ | B32B 29/00 | 493/51 |
| 2011/0095245 | A1 * | 4/2011 | Munson | D21H 21/34 | 252/607 |
| 2017/0229207 | A1 * | 8/2017 | Qu | H01B 3/04 | |
| 2020/0269554 | A1 * | 8/2020 | Noda | D21H 19/82 | |

* cited by examiner

*Primary Examiner* — Mark Halpern
(74) *Attorney, Agent, or Firm* — Carmody Torrance Sandak & Hennessey LLP

(57) ABSTRACT

A fire-resistant retail product packaging, such as sleeves, pouches, wraps, and the like, that is capable of containing fires of high intensity for products such as lithium-ion batteries. The fire-resistant paper comprises Kraft paper with a preferred eight of 40 to 60 pounds/3,000 $ft^2$, and a fire-resistant ink applied to each side of the Kraft paper. The fire-resistant ink includes an acrylic resin, a dispersant, and a boron compound, and optionally, talc and a molybdate compound. When heated, the fire-resistant ink preferably converts the Kraft paper into a non-combustible and heat shielding substance.

19 Claims, No Drawings

FIRE RESISTANT RETAIL PRODUCT PACKAGING MATERIALS AND METHOD OF MANUFACTURING SAME

FIELD OF THE INVENTION

The present invention relates generally to paper sleeves, pouches, wraps, and the like, for retail product packaging applications with fire resistant characteristics that can contain fires of high intensity and long duration, including those associated with lithium-ion batteries, and a method of producing, such paper products.

BACKGROUND OF THE INVENTION

Despite technological advances, lithium-ion batteries continue to be potentially dangerous. Lithium-ion batteries pose unique safety hazards because they contain a flammable electrolyte and only a thin piece of plastic separates the electrodes. If damaged, mishandled, or imperfectly manufactured, lithium-ion batteries can ignite and explode. Specifically, if the plastic separator fails, the electrodes can make contact, short circuit, and create an electric charge that ignites the electrolyte. Once one battery cell is ignited, thermal runaway can occur and ignite other cells within the same battery and cells in adjacent batteries.

Despite their inherent hazards, the demand for lithium-ion batteries continues to grow exponentially, particularly with the increased demand for use in electric vehicles and in portable devices. For example, lithium-ion batteries are increasingly used in cellphones, laptop computers, cameras, and rechargeable power tools. As automobiles, consumer electronics and devices of all kinds come to rely on lithium-based batteries for power, the question of lithium-ion battery safety becomes increasingly acute.

U.S. Pat. No. 11,028,535 to Mort, et al., the subject matter of which is herein incorporated by reference in its entirety, discloses a pleated paper for protecting packages during shipping that comprises at least one planar sheet of Kraft paper and one pleated sheet of Kraft. A fire suppressive ink is applied to the surfaces of the Kraft papers, both pleated and planar. The fire suppressive ink includes at least one inorganic fusible salt that releases water through dehydration or decomposition when the ink is heated to a certain temperature. Mort, et al., thus disclosed a pleated packaging paper that retained the inherent benefits of pleated paper protecting shipped packages (environmentally friendly, resiliently rigid, protective, flexible, and moldable), while also providing the ability to suppress a fire by the release of moisture when the fire suppressive ink is heated.

While the invention disclosed by Mort, et al., has been found to be successful in protecting lithium-ion batteries, and other flammable goods, during transportation, Mort, et al., fails to address and mitigate the dangers of lithium-ion batteries at all other times. For example, the distribution chain for lithium-ion batteries includes original equipment manufacturers, wholesale distributors, and retailers, where batteries are stored or displayed and not packaged for shipping. Thus, despite the solution disclosed by Mort, et al., and its success in protecting packages of lithium batteries during shipping, a need still exists for protecting lithium-ion batteries, and other flammable products, from fire and thermal runaway at all other times, including storage and retail display.

SUMMARY OF THE INVENTION

It is an object of the present invention to provide a method of producing a fire resistant paper that is recyclable, biodegradable, and environmentally friendly, with fire retardant qualities for items, such as lithium-ion batteries, which can create high intensity fires of long duration.

It is another object of the present invention to provide a method of producing a fire resistant paper that is capable of resisting and containing intense fires of long duration to avoid thermal runaway.

It is another object of the present invention to provide retail product packaging solutions, such as sleeves, pouches, wraps, and the like, for products, such as lithium-ion batteries, which contain fires and protect products from high intensity fires and thermal runaway.

DETAILED DESCRIPTION OF THE PREFERRED EMBODIMENTS

"A," "an" and "the" as used herein refer to both singular and plural referents unless the context clearly dictates otherwise.

As used herein, the term "about" or "approximately" refers to measurable value such as a parameter, an amount, a temporal duration, and the like and is meant to include variations of +/−15% or less, preferably variations of +/−10% or less, more preferably variations of +/−5% or less, even more preferably variations of +/−1% or less, and still more preferably variations of +/−0.1% or less of and from the particularly recited value, in so far as such variations are appropriate to perform in the invention described herein. Furthermore, it is also to be understood that the value to which the modifier "about" or "approximately" refers is itself specifically disclosed herein.

As used herein, the terms "comprises" and/or "comprising," specify the presence of stated features, integers, steps, operations, elements, and/or components, but do not preclude the presence or addition of one or more other features, integers, steps, operations, elements, components, and/or groups thereof.

As used herein, the term "consisting essentially of" specifies a composition that does not contain any additional ingredients that would affect the ability of the pleated paper to suppress or resist fire.

The inventors of the present invention have developed a method of producing environmentally friendly, retail paper packaging solutions that are fire resistant and capable of containing high intensity fires, such as those associated with lithium-ion batteries. In one embodiment, the inventors discovered that packaging material, such as Kraft paper, when coated with a specialized fire-retardant ink, can suppress, and contain high intensity fires of long duration.

In one embodiment, the present invention relates generally to a method of creating fire-resistant paper comprising the steps of:

a. providing Kraft paper, and b. applying a fire-resistant ink to at least one side of the Kraft paper, wherein the fire-resistant ink comprises an acrylic resin, a dispersant, and at least one boron compound.

In one embodiment, the packaging material comprises Kraft paper, corrugated cardboard, newsprint, or other packaging paper that is capable of absorbing the fire-resistant ink of the present invention.

The first step is to provide sheets of Kraft paper or other packaging material. Kraft paper is generally defined as paper or cardboard that is produced from chemical pulp produced in the kraft process. Kraft paper is generally strong, durable and tear resistant and thus provides an added protective layer for the product. Kraft paper is also textured and porous. This allows the paper to absorb coatings and inks for both functional and ornamental purposes. For example, Kraft paper has been found to absorb the fire-resistant ink of the present invention as well as inks used in high quality printing processes usable for branding purposes. One preferred Kraft paper is a virgin paper, and most preferably a virgin liner paper. In one embodiment, the Kraft paper has a basis weight in the range of 25 pounds to 75 pounds per 3,000 $ft^2$, more preferably 40 to 60 pounds per 3,000 $ft^2$, and most preferably about 50 pounds per 3000 $ft^2$.

The second step of the present invention is the creation of a fire-resistant ink. The fire-resistant ink comprises an aqueous coating comprising an acrylic resin, a dispersant and at least one boron compound.

In one embodiment, the acrylic resin is a thermoplastic material that is derived from one or more of acrylic acid, methacrylic acid and acrylate monomers and/or methacrylate monomers. The acrylic resin may be present in the aqueous coating at a concentration in the range of about 5 to about 30 wt. %, more preferably 10 to 20 wt. %.

The dispersant may be a surfactant, which surfactant may be a non-ionic surfactant. In one embodiment, the non-ionic surfactant has a hydrophilic polyethylene oxide chain and an aromatic hydrocarbon lipophilic or hydrophobic group. In one embodiment, the non-ionic surfactant comprises polyethylene glycol tert-octylphenyl ether, available from Sigma Aldrich under the tradename Triton™ X-100. The dispersant may be present in the aqueous coating at a concentration in the range of about 1 to about 25 wt. %, more preferably 2 to about 20 wt. %.

The aqueous coating composition also comprises at least one boron compound, which may be a borate salt or other borate compound, including hydrated borate of sodium (i.e., borax) or boric acid, by way of example and not limitation which is dissolvable in water. Borax has the beneficial attribute of suppressing flame propagation and combustion, while boric acid suppresses glowing, smoldering and smoke. Because of their complementary qualities, borax and boric acid may be used together. In addition, boron compounds can be combined with other compounds, which have beneficial fire-retardant qualities, such as phosphorous, nitrogen, antimony, and sulfur-based compounds. The boron compound may be present in the aqueous coating at a concentration in the range of about 2 to about 10 wt. %, more preferably 4 to about 8 wt. %.

In one embodiment, the aqueous composition optionally, but preferably, comprises talc or talcum powder. Talc is a clay material, composed of hydrated magnesium silicate. Talc is not flammable and has been found to improve the heat shielding properties of the fire-resistant aqueous coating. By forming high temperature compounds, talc improves the thermal insulation and heat shielding properties of the fire-resistant ink. If used, the talc is present in the aqueous composition at a concentration in the range about 5 to about 30 wt. %, more preferably about 10 to about 20 wt. %.

In one embodiment, the aqueous composition optionally, but preferably, comprises a molybdate compound such as calcium molybdate or zinc molybdate which may be present in the composition at a concentration in the range of about 5 to about 50 wt. %, more preferably about 10 to about 40 wt. %. Molybdate compounds have a high melting point and can be used in the composition to promote char formation and suppress smoke.

The aqueous composition may include additional materials including, but not limited to, inert ingredients such silica, pigments, and other inactive filler materials.

In one embodiment, the aqueous composition consists essentially of an acrylic resin, a dispersant, which dispersant comprises a non-ionic surfactant, at least one boron compound, talc, and at least one molybdate compound.

In one embodiment, the aqueous composition consists of an acrylic resin, a dispersant, at least one boron compound, talc, and at least one molybdate compound.

The fire-resistant ink, when heated, converts the otherwise combustible Kraft paper or other packaging material into a flame-resistant and non-combustible material. Boron compounds have relatively low melting points, and when heated to a temperature that exceeds the melting point, chemically react with the Kraft paper to form a charred, glassy structure. This charred, glassy structure causes the otherwise combustible Kraft paper to become fire-resistant and non-combustible. The charred, glassy structure also inhibits the flow of combustible volatiles. Additionally, the boron compounds penetrate the Kraft paper and thereby make the entire thickness of the Kraft paper non-combustible and fire-resistant (i.e., not just the surface). Thus, the Kraft paper coated with the fire-resistant ink cannot be used as combustible fuel for the fire and, instead, becomes an effective barrier to block, contain and shield the fire.

The performance of the fire-resistant ink depends not only on its chemical make-up, but also the means of application and the quality of the applied coating.

In one embodiment, the fire-resistant ink is applied to the Kraft paper or other packaging material by means of a flexographic printing process. Flexographic printing is designed to print bold and highly detailed colored graphics. However, the flexographic printing process can be altered to apply the fire-resistant ink of the instant invention to the Kraft paper.

A typical flexographic printing plate comprises various layers including a photosensitive printing layer and the printing layer typically has raised areas that accept ink from an anilox roller and print along with non-raised areas that do not receive ink from the anilox roller and do not print. However, the printing layer of the flexographic printing plate of the instant invention does not have raised and non-raised areas. Instead, it is planar and the anilox roller is used to apply a precise amount of fire-resistant ink uniformly to the Kraft paper using the flexographic printing plate described herein. The total amount of ink applied is preferably within the range of about 0.01 to about 0.002 pounds/$ft^2$, more preferably about 0.0010 to about 0.0015 pounds/$ft^2$, more preferably about 0.0014 pounds;$ft^2$. In one embodiment, the fire-resistant ink is applied in one or more coats on each side of the Kraft paper, more preferably the fire-resistant ink is applied as two coats on each side of the Kraft paper to apply the total amount of fire-resistant ink to each side of the Kraft paper. This results in approximately one pound of dry coating per 3,000 $ft^2$ of Kraft paper.

Thereafter, a flexographic printing process or other printing process is used to optionally, but preferably, print images such as branding information, logo images, or other images for the retail product package on the coated fire-resistant paper. In this manner, the inventive fire-resistant paper performs both a functional and branding purpose.

The functional benefits and attributes of the disclosed invention are exemplified by the following, examples.

Example 1: Battery sleeves were created according to the disclosed invention in which Kraft paper was coated with the fire-resistant ink described herein and then joined to form battery sleeves to encircle lithium-ion batteries. The battery sleeves were then placed around three lithium-ion batteries. The three lithium-ion batteries were held closely together with fiber glass tape.

The center battery was punctured with a nail and burst into flames. The battery sleeves contained the fire and prevented the fire from spreading to the two adjacent batteries. Temperature probes showed the center battery reached a temperature approaching 600° C., while the invented fire-resistant paper sleeves kept the temperature of the two adjacent batteries at 100° C.

Comparative Example 2: Three lithium-ion batteries of the same type and size as used in Example 1 were held closely together with fiber glass tape. No battery had a paper sleeve of the invention. The center battery was punctured with a nail and burst into flames. The fire was so intense that it caused the two adjacent batteries to catch fire. Temperature probes showed all three batteries reached a temperature approaching 600° C.

The above experiments readily demonstrate that the inventive paper sleeve can contain intense fires associated with lithium batteries and prevent thermal runaway. Without being bound to any particular theory, it is believed that the inventive paper sleeve provides a non-combustible heat shield that contains the fire and heat associated with the combustible battery, while also protecting the neighboring batteries by suppressing the formation of hydrogen and toxic halogen acid gases such as hydrofluoric acid.

The inventive fire-resistant paper is an environmentally friendly packaging material with improved fire protective qualities, which can contain fires of high intensity and long duration. The inventive fire-resistant paper is particularly useful for retail packaging and protecting lithium batteries used to power vehicles, drones, and the like.

What is claimed is:

1. A method of creating fire-resistant paper comprising the steps of:

providing a Kraft paper, and applying a fire-resistant ink to each side of the Kraft paper, wherein the fire-resistant ink comprises an acrylic resin, a dispersant, and at least one boron compound.

2. The method of claim 1 further comprising the step of using a flexographic printing process to apply the fire-resistant ink to each side of the Kraft paper.

3. The method of claim 1, wherein the at least one boron compound comprises one or more of boric acid and borax.

4. The method of claim 1, wherein the dispersant comprises a non-ionic surfactant.

5. The method of claim 1, wherein the fire-resistant ink further comprises talc.

6. The method of claim 1, wherein the fire-resistant ink further comprises a molybdate compound.

7. The method of claim 6, wherein the molybdate compound is zinc molybdate.

8. The method of claim 1, wherein the fire-resistant ink, when heated, converts the Kraft paper into a non-combustible material.

9. The method of claim 1, wherein the fire-resistant ink, when heated, reacts with the Kraft paper to form a charred, glassy surface.

10. Fire-resistant paper comprising:

a. Kraft paper having a basis weight of 40 to 60 pounds per 3,000 $ft^2$;

b. a coating of fire-resistant ink on each side of the Kraft paper, wherein the fire-resistant ink comprises an acrylic resin, a dispersant, and at least one boron compound.

11. The fire-resistant paper of claim 10, wherein the at least one boron compound comprises one or more of boric acid and borax.

12. The fire-resistant paper of claim 10, wherein the dispersant comprises a non-ionic surfactant.

13. The fire-resistant paper of claim 10, wherein the fire-resistant ink further comprises talc.

14. The fire-resistant paper of claim 10, wherein the fire-resistant ink further comprises a molybdate compound.

15. The fire-resistant paper of claim 14, wherein the molybdate compound is zinc molybdate.

16. The fire-resistant paper of claim 10 wherein the fire-resistant ink, when heated, converts the Kraft paper into a non-combustible material.

17. The fire-resistant paper of claim 10, wherein the fire-resistant ink, when heated, reacts with the Kraft paper to form a charred, glassy surface.

18. The fire-resistant paper of claim 10, wherein the fire-resistant ink is applied using a flexographic printing process.

19. A tire-resistant product packaging made by the method of claim 1.

* * * * *